United States Patent [19]

Higgins et al.

[11] Patent Number: 4,685,162

[45] Date of Patent: Aug. 11, 1987

[54] BOX SPRING HAVING IMPROVED COIL SPRING MODULES

[75] Inventors: Larry Higgins; Thomas J. Wells, both of Carthage, Mo.

[73] Assignee: Leggett & Platt, Incorporated, Carthage, Mo.

[21] Appl. No.: 854,531

[22] Filed: Apr. 22, 1986

[51] Int. Cl.[4] ..... A47C 23/02; A47C 23/00

[52] U.S. Cl. ..... 5/247; 5/255

[58] Field of Search ..... 5/267, 273, 274, 247, 5/248, 255

[56] References Cited

U.S. PATENT DOCUMENTS

| | | | |
|---|---|---|---|
| 1,854,503 | 4/1932 | Dietrich | 5/273 |
| 2,433,418 | 12/1947 | Bloch | 5/273 |
| 2,454,965 | 11/1948 | Elder | 5/247 |
| 3,248,745 | 5/1966 | Gunlock | 5/247 |
| 3,577,574 | 5/1971 | Ciampa et al. . | |
| 4,112,528 | 9/1978 | Higgins . | |
| 4,160,544 | 7/1979 | Higgins . | |
| 4,510,635 | 4/1985 | Woffendin | 5/247 |

*Primary Examiner*—John E. Murtagh

*Attorney, Agent, or Firm*—Wood, Herron & Evans

[57] ABSTRACT

A box spring for supporting a bedding mattress. The box spring includes a rectangular base frame, a plurality of modular spring elements mounted atop the base frame, and a wire grid mounted atop the modular spring elements. Each of the modular spring elements comprises a horizontal straight center section terminating in horizontal plane curved end sections, at least some of the curved end sections having single revolution coil springs extending vertically downwardly therefrom. The modular spring elements are arranged in parallel rows, said adjacent spring elements of each row having aligned straight center sections and overlapping curved sections. The overlapping curved center sections of adjacent modular spring elements are connected by transverse wires of the grip top, which transverse wires have generally U-shaped bights or hooks from therein received over the overlapping curved sections and crimped shut to secure adjacent modular spring elements of multiple rows of modular spring elements to one another.

9 Claims, 4 Drawing Figures

BOX SPRING HAVING IMPROVED COIL SPRING MODULES

This invention relates to box springs and more particularly, to box springs having improved modular spring elements for resiliently supporting a mattress atop the box spring.

Box springs have traditionally comprised a wooden base frame, a plurality or matrix of coil springs mounted atop the wooden base frame, and a planar mattress supporting surface located atop the coil spring. Quite commonly, that planar mattress supporting surface comprised the top turns or revolutions of the coil springs and a series of helical springs which interconnected those top turns to a border wire. Alternatively, that planar top surface often comprised a wire grid having a plurality of intersecting wires extending between opposite sides of a border wire and connected to the top turns or revolutions of the coils.

There has of late been a movement away from coil springs for providing the resilient support between the wooden base frame and the top planar surface of a box spring. In the course of that movement, some form of wire module has generally been substituted for the coil springs in an effort to reduce the quantity of wire and thus the cost of the box spring while still retaining the traditional firmness and resiliency characteristics of the box spring. That traditional firmness and resiliency characteristic is generally required in order for the box spring to be commercially viable as a mattress supporting surface.

One early effort to reduce the quantity of wire in a box spring involved forming two coils from a single strand of wire interconnected by a straight length of wire extending between the top turns of the two interconnected coils. These double coil spring elements or modules each generally incorporated at least three full revolutions or turns in each vertical leg of the module to acheive a conventional 5 or 5½ inch height box spring. Generally, these double coil modules were connected at the bottom to a wooden frame and at the top to a wire grid having transverse and longitudinal wires extending between opposite sides of a rectangular border wire overlying the peripheral edge of the rectangular wooden frame. This type of double coil module box spring has not been commercially viable in the Unites States because it is too costly to manufacture compared with other alternative modular spring-type box springs having approximately the same firmness, resiliency, and mattress supporting characteristics. In general, the excessive cost for this type of box spring has been attributable to the cost of the relatively heavy gauge wire from which the module is manufactured.

A more recent effort to improve upon the above-described box spring is illustrated in U.S. Pat. No. 4,510,635. This patent discloses a box spring which incorporates a plurality of modular spring elements formed from a single length of wire having a straight central section terminating in curved end sections extending into vertical spring legs. In one modificatin, the spring legs are formed as single revolution coils. The modules are arranged in lengthwise rows with the central elongate sections of each module colinearly aligned and with the adjacent curved sections of the modules in each row secured together by helical connecting wires. The box springs disclosed in this patent, though, and particularly the modifications which incorporate single revolution coils in the spring legs of the modules, is characterized by being subject to excessive deflection under concentrated loading conditions and of having the wire in the top planar section of the box spring take a set when excessively loaded, as for example when a person stands on the top of the box spring. This tendency of the wires of the top planar surface of the coil spring to take a set is undesirable and commercially unacceptable. Additionally, the box spring disclosed in this patent when manufactured commercially in accordance with the disclosures of the patent, is too flexible or lacking in firmness to be acceptable for most box spring applications.

It has been an objective of this invention to provide an improved box spring which overcomes the problems of the two above-described box springs. Otherwise expressed, it has been an objective of this invention to reduce the quantity of wire required to acheive a firm, but still flexible, planar supporting surface in a box spring having two coils formed from a single length of wire and interconnected at the top by a straight section of wire.

Another objective of this invention has been to provide a box spring which may be manufactured from a minimum of wire while still retaining the desirable firmness and resiliency characteristics of an acceptable box spring and without creating any large unsupported areas in the top planar surface of the spring.

In accordance with the practice of the present invention, the box spring having these characteristics comprises a rectangular base frame, a plurality of modular spring elements mounted atop that frame, and a wire grid mounted atop the modular elements. Each of the modular elements comprises a horizontal straight center section terminating in curved horizontal end sections with at least some of the curved end sections having vertical spring sections extending downwardly therefrom. The modular elements are arranged in parallel rows with adjacent elements of each row aligned straight center sections and overlapping curved sections. The wire grid, which is mounted atop the modular elements, comprises a rectangular border wire and parallel grid wires extending between opposed sides of the border wire, which parallel grid wires have generally U-shaped bights formed therein and received over and crimped around the overlapping curved sections of adjacent modular elements to secure the adjacent modular elements to one another. The top surfaces of the modules and the grid wires form a top surface on the box spring which has minimal size holes or vertical unsupported open areas for supporting a mattress atop the box spring. To further reduce the size of "holes" or unsupported areas in that top surface, additional grid wires may be provided which extend parallel to the aligned straight center sections of the rows of modular elements.

In accordance with the invention of this application, the spring sections of each modular element comprises a single revolution coil extending between the curved section of the modular element and the base frame, which single revolution coil is approximately 2 inches in diameter and at least 5 inches in height. Coils so dimensioned have been found to have the desired firmness characteristic while still retaining sufficient resiliency to be acceptable in a mattress supporting box spring.

In a second modification of the invention of this application, only alternate ones of the modular elements in a row of modular elements have spring sections extending vertically downwardly therefrom. As a consequence, those modular elements of a row of elements having spring legs extending downwardly therefrom are interconnected by generally C-shaped modules so as to further reduce the quantity of wire employed in the box spring.

The box spring of this invention has the advantage over prior art box springs of being less expensive than prior art box springs which have the same overall dimensions and the same firmness and resiliency characteristics.

These and other objects and advantages of this invention will be more readily apparent from the following description of the drawings in which.

Figure 1:
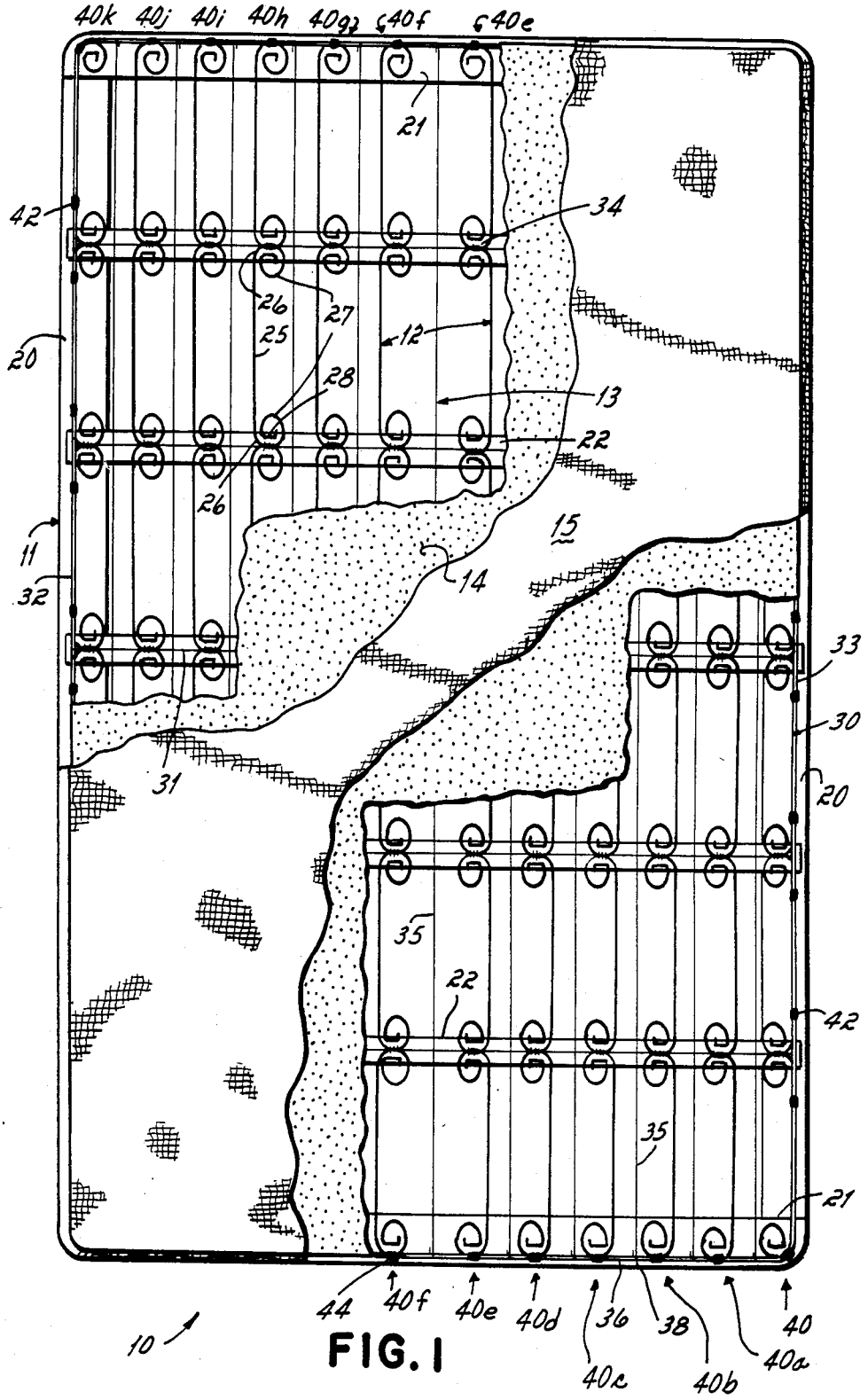
FIG. 1 is a top plan view, partially broken away, of a box spring incorporating the invention of this application.

With reference first to FIG. 1, there is illustrated a box spring 10 incorporating the invention of this application. This box spring comprises a conventional rectangular wooden base frame 11, a plurality of identical resilient modular elements 12 mounted atop the base frame 11, and a wire grid 13 supported by the modular elements 12 approximately five inches above the base frame 11. Covering the wire grid there is a conventional fabric pad 14. The complete box spring assembly, including the base frame 11, modular elements 12, and wire grid 13, as well as the fabric pad 14, are encased within a conventional upholstered covering 15.

Figure 2:
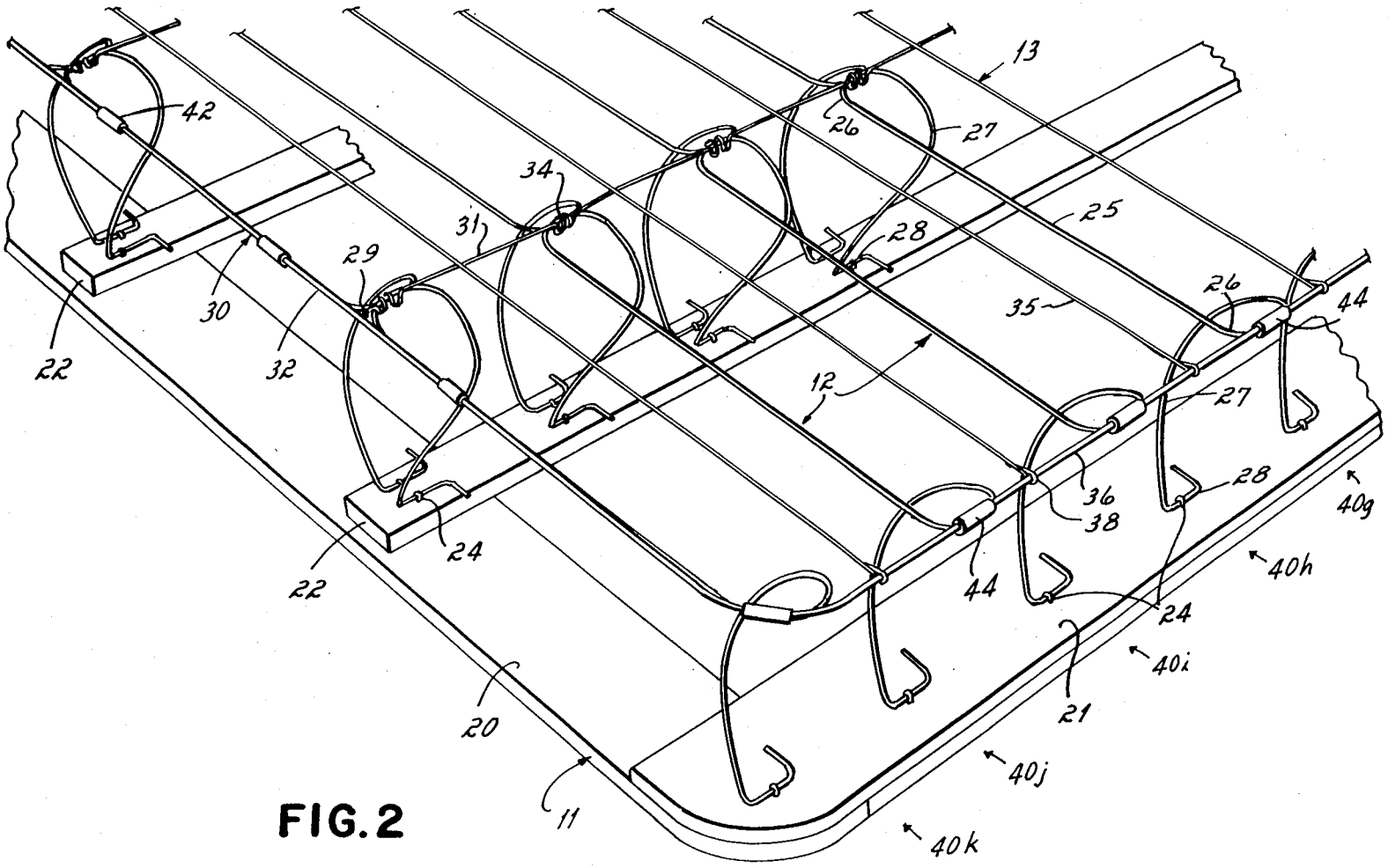
FIG. 2 is a perspective view of a corner section of the box spring assembly of FIG. 1, but with the covering material and upholstery of the box spring removed.

With reference now to FIGS. 1 and 2, it will be seen that the base frame 11 comprises a pair of opposed side boards 20 connected at the ends by end boards 21. Intermediate the end boards there are a plurality of transverse slats 22 extending between and fixedly secured to the side boards 20.

Figure 3:
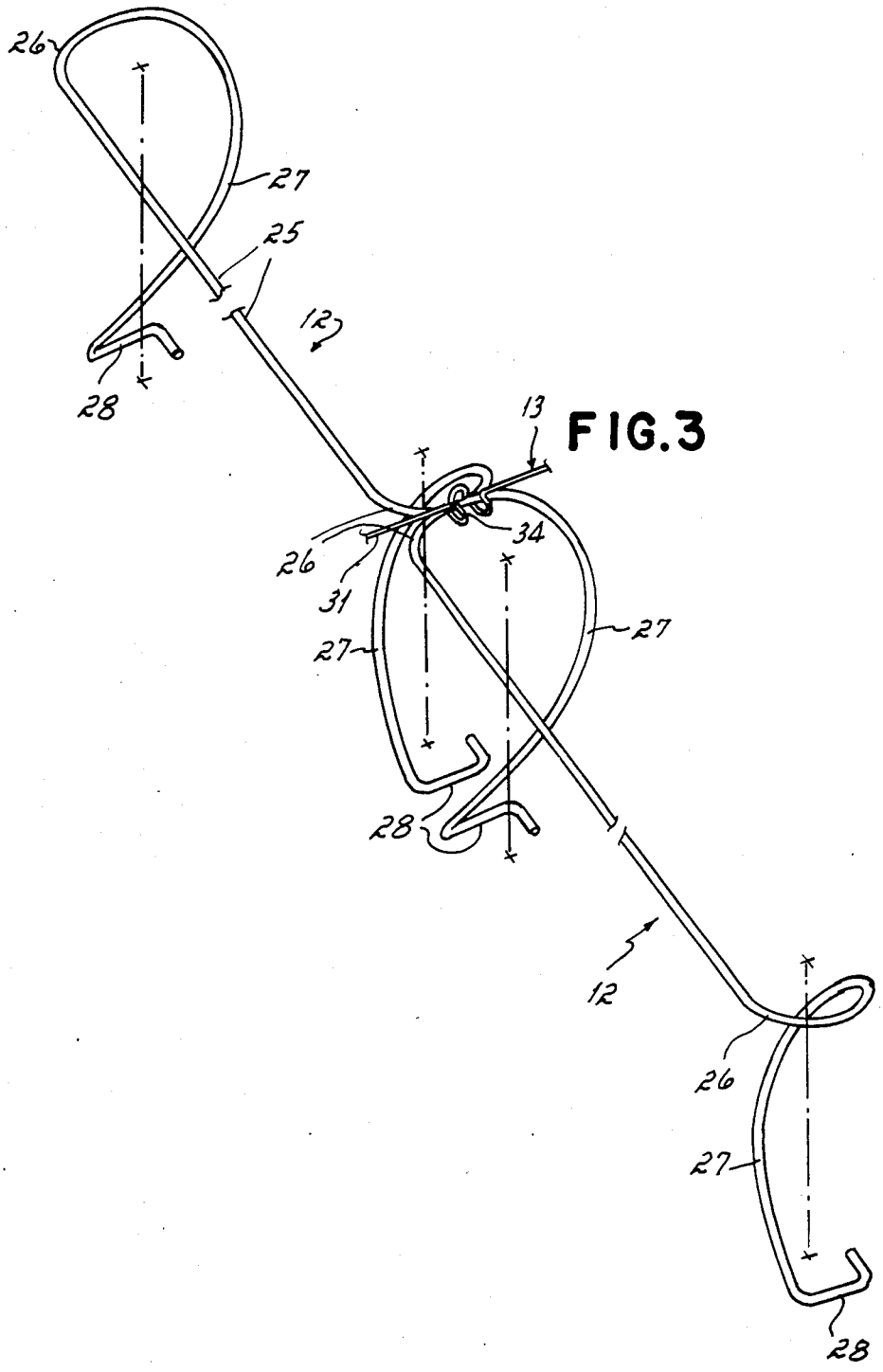
FIG. 3 is a perspective view of two aligned modular elements in one row of elements of the box spring of FIG. 1.

With reference now to FIGS. 2 and 3, it will be seen that each modular element 12 is manufactured from a single strand of wire having a straight central section 25 which terminates at each end in a curved or arcuate end section 26. Extending from each curved end section, there is a single revolution coil spring leg 27. Each of these coil spring legs 27 in turn terminates at its lower end in a generally right angle end section or foot 28. This foot 28, as shown most clearly in FIG. 2, is stapled or otherwise fixedly secured onto the top of the end boards 21 and slats 22 of the base frame 11 by staples 24. In accordance with the practice of this invention, each of the single revolution coil springs or legs 27 of the modular elements 12 is approximately 2 inches in diameter and approximately 5 to 5½ inches in height. When so dimensioned, the modular element of this invention has been found to have the desirable firmness charcteristics required for a spring module usable in a box spring of approximately 6 inches overall height. This is the relatively standard height for box springs in the United States and in some countries foreign to the United States.

The wire grid 13 includes a rectangular border wire 30 overlying the peripheral edge of the rectangular base frame 11. A plurality of transverse grid wires 31 extending between opposed sides 32, 33 of the border wire. The ends of these grid wires 31 terminate short of the border wire and are bent downwardly as illustrated at 29. Intermediate the ends of the transverse grid wires 31 there are a plurality of equidistantly spaced, generally U-shaped bights or hooks 34 formed in the grid wires 31. In the illustrated embodiment there are ten such equidistantly spaced bights or hooks 34 formed in each transverse wire. The number of such bights or hooks, though, as explained more fully hereinafter, depends upon the number of rows of modular elements to be connected by the bights or hooks 34.

The bights or hooks 34 formed in the grid wires 31 are conventional and therefore are not described in detail in this application. Suitable bights or hooks formed in box spring grid wires are completely illustrated and described in U.S. Pat. No. 1,854,503 or U.S. Pat. No. 3,577,574. Other shaped bights or hooks may be found in the grid wires 31 and substituted for the illustrated hooks 34. Alternatively, clips may be substituted for the grid wire bights or hooks.

In the preferred embodiment of the wire grid 13 illustrated in FIGS. 1–4, the wire grid 13 also includes a plurality of longitudinal wires 35 extending parallel but medially spaced between adjacent rows of modular elements. These longitudinal wires 35 are preferably wrapped around the ends 36 of the border wire as illustrated at 38 and may be welded thereto.

With reference now to FIGS. 1 and 2, it will been seen that the modular elements 12 are arranged in longitudinally extending rows 40, **40*a*, 40*b* through 40*k*. Within each row, adjacent modular elements 12 have the straight central sections 25 thereof colinearly aligned. The curved end sections 26 of adjacent modular elements 12 within a row are overlapped and, as may be seen most clearly in FIG. 2, the overlapped portions are received within a U-shaped bight or hook 34 of a transverse grid wire 31. After reception of the overlapped curved sections 26 of adjacent modular elements 12 within the U-shaped bights or hooks 34, the U-shaped bights or hooks are crimped shut so as to positively lock the curved sections 26 of adjacent modular elements 12 to one another. In order to secure the border wire to the outermost modular elements 12, the straight sections of those modular elements in rows 40 and 40*k* are connected by sheet metal clips 42 to the sides 32, 33 of the border wire. Furthermore, the curved end sections 26 of the endmost modular units 12 in each row of modular units are connected to the ends 36 of the border wire 30 by sheet metal clips 44**.

With particular reference to FIG. 2, it will be seen that in order to secure the hooks 34 onto the overlapping curved sections 26 of adjacent modular elements 12, the grid wires having the generally U-shaped bights or hooks formed therein are first placed over the tops of the overlapping curved sections of adjacent modular elements 12. Each transverse wire is then rotated approximately 90° so as to secure the hooks around the overlapped sections 26 of adjacent modular elements 12. Thereafter, the hooks are crimped shut, and the modular elements are thereby fixedly secured to the adjacent overlapped modular elements.

After completion of the spring assembly by connection of the modular elements 12 to the base frame 11 and subsequent attachment of the grid 13 to the top planar sections of the grid element 12, the box spring is completed by placement of the fabric pad 14 over the top of the wire grid 13. The complete assembly is then encased within a conventional upholstery covering 15.

The advantage of the box spring described hereinabove relative to prior art box springs is that it results in a box spring assembly having very desirable firmness and resiliency characteristics in a box spring which has an overall height of approximately 6 inches. It also is characterized by a mnimum of wire in a complete box spring so that the box spring may be manufactured relatively inexpensively for a box spring of this resiliency and firmness characteristics. This box spring is also characterized by relatively small size "holes" in the top surface of the box spring so that if a person steps on the top of the box spring for example, he cannot fall through or permanently deform a relatively unsupported section of the box spring.

Figure 4:
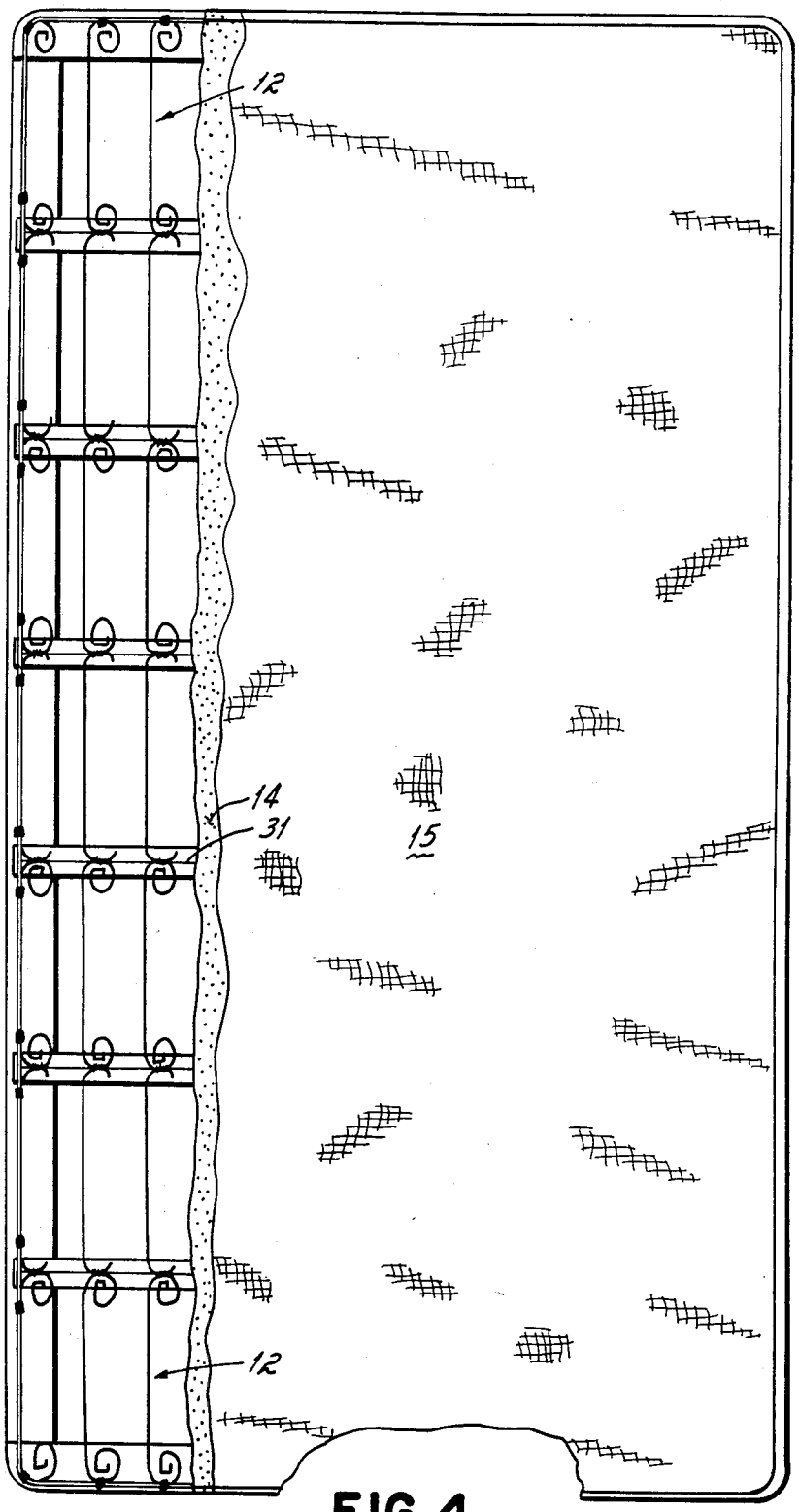
FIG. 4 is a top plan view of a second modification of the box spring of this invention.

With reference now to FIG. 4, there is illustrated a second embodiment of the invention of this application. This embodiment is identical to the embodiment of FIGS. 1–3 except that the modular elements of alternate ones of the spring elements in a row of spring elements 12 terminates at the end of the curved section 26. Otherwise expressed, in this embodiment alternate ones of the modular elements 12 in each row of modular elements have no vertical coil spring-shaped leg section 27 or foot section 28. In some applications, the omission of the vertical coil sections in alternate ones of the modular elements may result ina substantial material savings and therefore cost savings while sacrificing relatively little firmness. In all other respects, the modification of FIG. 4 is identical to the spring assembly of FIGS. 1–3.

While we have described only two preferred embodiments of our invention, persons skilled in the art to which this invention pertains will readily appreciate changes and modifications which may be made without departing from the spirit of our invention. Therefore, we do not intend to be limited except by the scope of the following appending claims.

We claim:

1. A box spring for supporting a bedding mattress, said box spring comprising a rectangular base frame, said base frame comprising a pair of opposed side members, a pair of opposed end members, and transverse slats extending between said side members, a plurality of modular elements mounted atop said base frame, each of said modular elements comprising a horizontal straight center section terminating in curved horizontal end sections, at least some curved end sections having spring sections extending vertically downwardly therefrom, said modular elements being arranged in parallel rows with adjacent elements of each row having aligned straight center sections and overlapping curved sections, said spring sections of said modular elements each including a single revolution coil spring approximately five inches in height and two inches in diamenter extending between said curved sections of said modular elements and said base frame, a wire grid mounted atop said modular elements, said wire grid comprising a rectangular border wire and parallel grid substantially straight, non-helical wires extending between opposed sides of said border wire, said border wire being connected to the endmost curved sections of said rows of modular elements and said parallel grid wires being fixedly secured to said overlapping curved sections of adjacent modular elements to secure adjacent modular elements of a row of modular elements to one another, a fabric pad overlying said wire grid, and an upholstered covering encasing said base frame, said modular elements, said wire grid, and said fabric pad.

2. A box spring assembly comprising a rectangular base frame, said base frame comprising a pair of opposed side members, a pair of opposed end members, and transverse slats extending between said side members, a plurality of modular elements mounted atop said base frame, each of said modular elements comprising a horizontal straight center section terminating in curved horizontal end sections, at least some curved end sections having spring sections extending vertically downwardly therefrom, said modular elements being arranged in parallel rows with adjacent elements of each row having aligned straight center sections and overlapping curved sections, said spring sections of said modular elements each including a single revolution coil spring approximately five inches in height and two inches in diameter extending between said curved sections of said modular elements and said base frame, and a wire grid mounted atop said modular elements, said wire grid comprising a rectangular border wire and parallel substantially straight, non-helical grid wires extending between opposed sides of said border wire, said border wire being connected to the endmost curved sections of said rows of modular elements and said parallel grid wires being fixedly secured to said overlapping curved sections of adjacent modular elements to secure adjacent modular elements of a row of modular elements to one another.

3. The box spring assembly of claim 2 wherein said parallel grid wires extend perpendicular to the aligned straight center sections of said row of said modular elements.

4. The box spring assembly of claim 3 wherein each of said grid wires has generally U-shaped bights formed therein and received over said overlapping curved sections of adjacent modular elements to fixedly secure adjacent modular elements to one another.

5. The box spring assembly of claim 2 wherein said grid further comprises additional grid wires extending perpendicular to said parallel grid wires, said additional grid wires extending parallel to said aligned straight center sections of said modular elements.

6. The box spring assembly of claim 5 wherein said additional grid wires are equidistantly spaced between adjacent rows of said modular elements.

7. The box spring assembly of claim 2 wherein only alternate ones of modular elements in each row of modular elements has spring sections extending downwardly therefrom.

8. The box spring assembly of claim 2 wherein each of said parallel grid wires is secured to said overlapping curved sections of adjacent modular elements by having said U-shaped bights in said parallel grid wires placed over said overlapped sections, rotated approximately 90° and then crimped shut at the open end of said U-shaped bights.

9. A box spring assembly comprising a rectangular base frame, said base frame comprising a pair of opposed side members, a pair of opposed end members, and transverse slats extending between side members, a plurality of modular elements mounted atop said base frame, each of said modular elements comprising a horizontal straight center section terminating in curved horizontal end sections, at least some curved end sections having spring sections extending vertically downwardly therefrom, said modular elements being arranged in parallel rows with adjacent elements of each row having aligned straight center sections and overlapping curved sectios, said spring sections of said modular elements each including a single active revolution coil spring approximately five inches in height and approximately two inches in diameter extending between said curved sections of said modular elements and said base frame, and a border wire and connector means mounted atop said modular elements, said connector means comprising substantially straight, non-helical elements extending between opposed sides of said border wire, said border wire being connected to the endmost curved sections of the endmost modular elements in each of said rows of modular elements, and said connector means being fixedly secured to said overlapping curved sections of adjacent modular elements to secure adjacent modular elements of a row of modular elements to one another.

* * * * *

UNITED STATES PATENT AND TRADEMARK OFFICE

CERTIFICATE OF CORRECTION

PATENT NO. : 4,685,162

DATED : August 11, 1987

INVENTOR(S) : Larry Higgins, et al.

It is certified that error appears in the above-identified patent and that said Letters Patent is hereby corrected as shown below: On the title page:

In the Abstract, line 15, change "grip" to --grid--.

Column 1, line 40, change "acheive" to --achieve--.

Column 1, line 47, change "Unites" to --United--.

Column 1, line 61, change "modificatin" to --modification--.

Column 2, line 18, change "acheive" to --achieve--.

Column 5, line 8, change "mnimum" to --minimum--.

Column 5, line 28, change "ina" to --in a--.

Column 5, line 38, change "appending" to --appended--.

Column 5, line 58, change "diamenter" to --diameter--.

Column 5, line 62, delete "grid".

Column 5, line 63, before "wires" insert --grid--.

Column 7, line 12, change "sectios" to --sections--.

Signed and Sealed this

Twentieth Day of December, 1988

*Attest:*

*Attesting Officer*

DONALD J. QUIGG

*Commissioner of Patents and Trademarks*